US007086628B2

(12) United States Patent
Neri

(10) Patent No.: US 7,086,628 B2
(45) Date of Patent: Aug. 8, 2006

(54) INK RIBBON CORE

(75) Inventor: Joel Neri, Youngstown, NY (US)

(73) Assignee: International Imaging Materials, Inc., Amherst, NY (US)

( * ) Notice: Subject to any disclaimer, the term of this patent is extended or adjusted under 35 U.S.C. 154(b) by 0 days.

(21) Appl. No.: 10/695,808

(22) Filed: Oct. 30, 2003

(65) Prior Publication Data

US 2005/0092865 A1 May 5, 2005

(51) Int. Cl.
*B65H 75/14* (2006.01)
*B65H 75/18* (2006.01)

(52) U.S. Cl. ..... 242/611.2

(58) Field of Classification Search ..... 242/611.2
See application file for complete search history.

(56) References Cited

U.S. PATENT DOCUMENTS 3,106,363 A * 10/1963 Epstein ..... 242/611.2
3,312,410 A * 4/1967 Strothmann ..... 242/422.4
5,833,377 A 11/1998 Keller et al.
5,947,618 A 9/1999 Keller et al.
6,425,551 B1 7/2002 Puckett et al.
6,609,677 B1 8/2003 Seybold et al.
6,609,678 B1 8/2003 Seybold et al.
2003/0080238 A1 5/2003 Seybold et al.
2003/0106957 A1 6/2003 Seybold et al.

* cited by examiner

*Primary Examiner*—Kathy Matecki
*Assistant Examiner*—Sang Kim
(74) *Attorney, Agent, or Firm*—Dickstein Shapiro Morin & Oshinsky LLP

(57) ABSTRACT

A core includes a tubular body that supports a wound sheet roll. The tubular body having open ends includes an annular outer surface receiving the sheet roll, and an annular inner surface defining a bore that receives a spindle. A plurality of ribs project inwardly from the body inner surface and extend axially between the open ends for nesting in corresponding slots in the spindle. Each of the ribs includes a bevel at one end for frictionally engaging a corresponding spindle slots to retain the core axially. Another set of frictional retention ribs projects inwardly from the body inner surface and extends radially between the axial ribs.

12 Claims, 1 Drawing Sheet

INK RIBBON CORE

BACKGROUND OF THE INVENTION

1. Field of the Invention

The present invention relates to printers and, more specifically, replaceable print rollers for printers.

2. Description of the Related Art

Many types of printers include a roll of material that is used in the printing process. A typical example includes a roll of printing paper, upon which information may be printed. The paper is wound in a continuous sheet on a supporting core, and the core is mounted on a spindle in the printer. In another example, thermal printers utilize thermal transfer ribbon wound on a core. The thermal transfer ribbon is thermally activated during printing.

When the printing paper or ribbon is depleted, the empty core is removed from the spindle and replaced with a fully wound core, thereby returning the printer to service. The core typically includes features for accurately retaining the core on the spindle, in proper axial alignment with the printing mechanism, and in proper circumferential alignment around the spindle. Known printers that utilize cores retained on a spindle are referred to in U.S. Pat. Nos. 5,833,377; 5,947,618; 6,425,551; 6,609,677; and 6,609,678, and U.S. patent application Ser. Nos. 2003/0080238 and 2003/0106957, the entire disclosures of which are incorporated herein by reference.

In one known design, the spindle includes three slots disposed axially around the perimeter. The slots receive corresponding straight axial splines projecting inwardly along the inner surface or bore of the core. The core may be inserted axially over the spindle by engaging the corresponding splines and slots, with the splines providing circumferential retention around the spindle to prevent slippage.

Additional features are required for locking the core in axial position over the spindle and preventing unintended liberation or misalignment, however. The additional features increase the complexity of the core and spindle assembly, and correspondingly increase the cost. Cost is a significant factor in the manufacture and use of printer rolls, and must be minimized to maintain competitive advantage in the market of supplying replacement printing rolls.

Accordingly, it is desired to provide a simple, effective, low-cost replacement core for receiving wound sheet rolls and having corresponding retention features for mounting to a supporting spindle.

SUMMARY OF THE INVENTION

The present invention provides a core for supporting a wound sheet roll on a spindle. The core has a tubular body with opposing open ends and includes an annular outer surface for receiving the sheet roll. An annular inner surface of the tubular body defines a bore for receiving the spindle. A plurality of circumferentially spaced apart splines project radially inward from the annular inner surface and extend axially between the open ends for nesting in corresponding slots in the spindle. At least one spline has a spline stop at one end for frictionally engaging a corresponding spindle slot to axially limit assembly of the core onto the spindle. The spline stop preferably is formed as a bevel on the one end of the spline. A set of ribs project radially inward from the inner surface near the one end and extend radially between the axial splines and engage features of the spindle for frictionally locking the core onto the spindle.

DETAILED DESCRIPTION OF PREFERRED EMBODIMENTS

Figure 4:
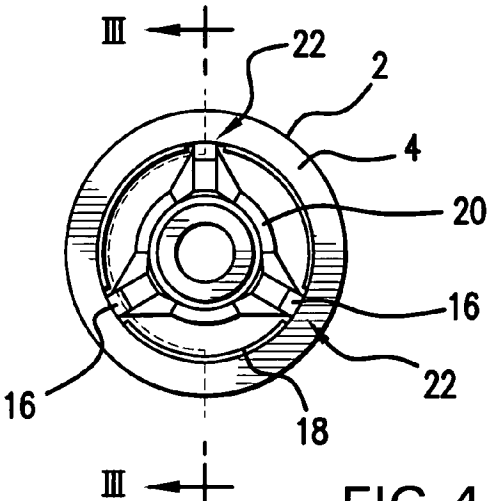
FIG. 4 is an end view of the ink ribbon core received on the spindle of FIG. 3.
Figure 2:
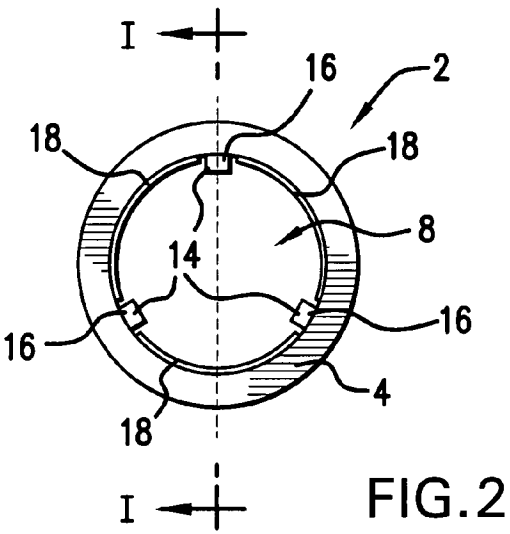
FIG. 2 is an end view of the ink ribbon core of FIG. 1.
Figure 3:
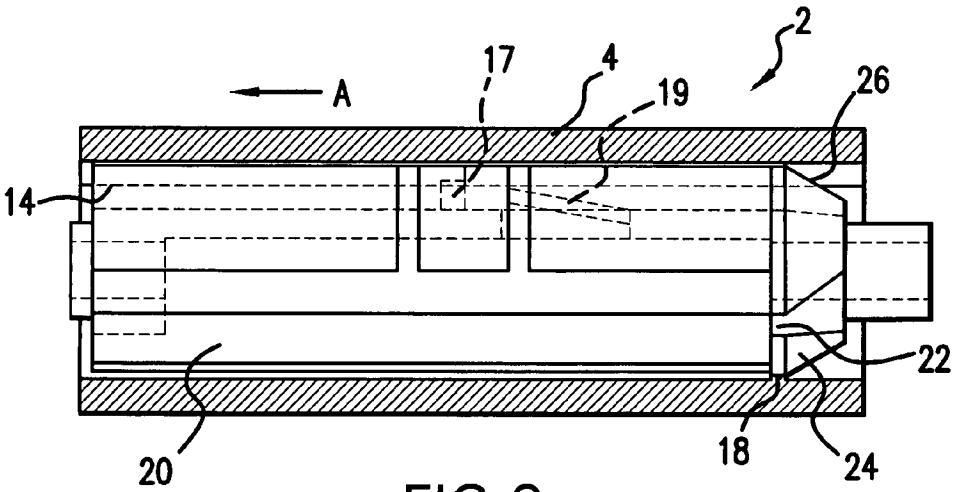
FIG. 3 is a cut-away elevation of the ink ribbon core of FIGS. 1 and 2 received on a spindle according to the present invention.
Figure 1:
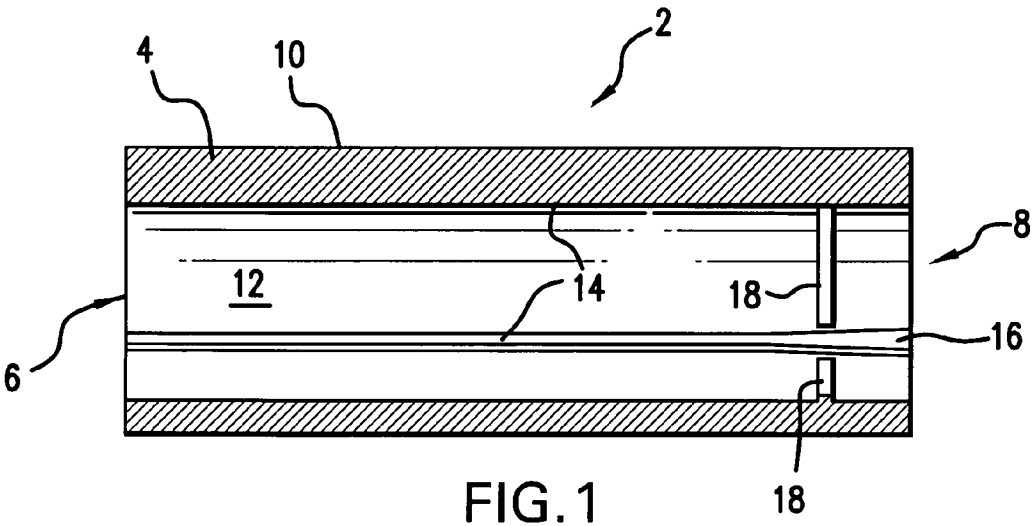
FIG. 1 is a cross sectional elevation of an ink ribbon core according to the present invention.

Referring initially to FIGS. 1 and 2, a molded core 2 is shown according to a preferred embodiment of the present invention. The core 2 supports a wound sheet roll (not shown) and includes a tubular body 4 having open ends 6, 8. The core 2 includes an annular outer surface 10 for receiving the sheet roll. An annular inner surface 12 defines a bore for receiving the spindle 20 (FIGS. 3 and 4). Three circumferentially, evenly-spaced apart splines 14 project radially inward from the inner surface 12 and extend axially between the open ends 6, 8 for nesting in corresponding slots 22 in the spindle 20. The splines 14 are generally rectangular in cross section, and at least one spline 14 includes a spline stop 16 in the form of an essentially incompressible widening bevel disposed at one end 8 of the spline 14 for frictionally engaging a corresponding spindle slot 22 to retain the core 2 axially.

A set of arcuate ribs 18 projects radially inward from the inner surface 12 near one end (8) of the tube 4. The ribs 18 extend radially between the splines 14 for frictionally retaining the spindle 20 within the core 2.

Referring to FIGS. 3 and 4, the core 2 is shown received on the spindle 20 in the assembled (filly-mounted) position. Spindle 20 includes spindle slots 22 formed in conical forward end 24. Spindle slots 22 receive the splines 14. Spline stops 16 wedge into spindle slots 22 to prevent further axial movement of the core 2 in the direction of arrow A in FIG. 3. A flat circumferential surface 26 is contiguous with the conical forward end 24. The surface 26 engages circumferential ribs 18 to frictionally lock core 2 into place on spindle 20. In the assembled position shown in the drawings, the cylindrical surface 26 is surrounded by the ribs 18. The frusto-conical shape of the leading end 24 of the spindle 20 guides the first end 6 of the core 2 and causes the surface 26 to move into the assembled position.

In a preferred embodiment, the spindle 20 is constructed to receive and operate with cores other than and in addition to the one shown in the drawings. The illustrated spindle 20 has a radially extending stop member 17 and a leaf spring 19 for operatively engaging such other cores (not shown). Thus, the present invention may be used to provide an uncomplicated injection molded ink ribbon core having only spline stops and a circumferential rib for retention of the illustrated core 2 on a printer spindle 20.

Although the present invention has been described in connection with preferred embodiments, many modifications and variations will become apparent to those skilled in the art. The above description and drawings are only illustrative of preferred embodiments which can achieve and provide the objects, features and advantages of the present invention. It is not intended that the invention be limited to the embodiments shown and described in detail herein. Modifications coming within the spirit and scope of the following claims are to be considered part of the invention.

The invention claimed is:

1. A core for supporting a wound sheet roll on a spindle, said core comprising:

a tubular body having open ends and including an annular outer surface for receiving the sheet roll;

an annular inner surface defining a bore for receiving the spindle;

circumferentially spaced apart splines projecting radially inward from the annular inner surface and extending axially between the open ends for nesting in corresponding slots in the spindle, at least one spline having a spline stop at one end for frictionally engaging the spindle to retain the core axially; and a set of ribs projecting radially inward from the annular inner surface near the one end and extending between the axial splines, each rib having a radially-oriented face arranged to frictionally engage an outer circumferential surface of the spindle.

2. The core of claim 1, wherein the spline stop is a bevel formed on the end of the spline.

3. The core of claim 1, wherein each spline includes a spline stop.

4. The core of claim 1, wherein an end of each rib is spaced from an adjacent spline.

5. The core of claim 1, wherein the splines are generally rectangular in cross section.

6. The core of claim 1, wherein the ribs are generally rectangular in cross section.

7. The core of claim 1, wherein there are three splines.

8. The core of claim 7, wherein the splines are spaced apart by about 120°.

9. The core of claim 1, wherein the set of ribs encircles at least half of the annular inner surface.

10. The core of claim 1, wherein the radially-oriented face is arranged to be mutually parallel with the outer circumferential surface of the spindle.

11. The core of claim 1, wherein the spline stop is provided as a solid triangle-shaped spline stop.

12. The core of claim 1, wherein the spline stop is mounted directly to the inner annular surface.

* * * * *